US006766890B2

(12) United States Patent
Hüsges et al.

(10) Patent No.: US 6,766,890 B2
(45) Date of Patent: Jul. 27, 2004

(54) STARTER MECHANISM FOR AN INTERNAL COMBUSTION ENGINE

(75) Inventors: Markus Hüsges, Gmund (DE); Etienne Chappatte, Avry-sur-Matran (CH); Martin Lambe, Kernen i. R. (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 10/212,371

(22) Filed: Aug. 2, 2002

(65) Prior Publication Data

US 2003/0024784 A1 Feb. 6, 2003

(30) Foreign Application Priority Data

Aug. 4, 2001 (DE) ..... 201 13 012 U

(51) Int. Cl.[7] ..... F02N 3/02

(52) U.S. Cl. ..... 192/42; 74/7 C; 123/185.3; 192/46

(58) Field of Search ..... 192/42, 46, 105 CD, 192/71, 74, 75, 109 R, 115, 63; 74/7 C; 123/185.3

(56) References Cited

U.S. PATENT DOCUMENTS

| | | | | | |
|---|---|---|---|---|---|
| 2,868,186 | A | * | 1/1959 | Schnacke | 123/185.3 |
| 2,869,531 | A | * | 1/1959 | Cedermark | 123/185.3 |
| 4,127,098 | A | * | 11/1978 | Frers et al. | 123/185.3 |
| 4,273,008 | A | * | 6/1981 | Ishihara et al. | 123/185.14 |
| 4,641,614 | A | * | 2/1987 | Krebs | 123/185.3 |
| 4,970,998 | A | * | 11/1990 | Tyler | 123/185.3 |
| 5,287,832 | A | * | 2/1994 | Uhl | 123/185.3 |
| 5,431,135 | A | * | 7/1995 | Tyler | 123/185.3 |
| 5,913,563 | A | * | 6/1999 | Watanabe et al. | 192/105 CD |

* cited by examiner

*Primary Examiner*—Rodney H. Bonck
(74) *Attorney, Agent, or Firm*—R W Becker & Associates; R W Becker

(57) ABSTRACT

A starter mechanism for an internal combustion engine for a motor-driven, manually-guided implement is provided. A clutch drum is rotatably mounted about a journal pin on a housing of the implement. The clutch drum is fixedly connected with a carrier of a ratchet for transfer of drive torque from the drum to the motor shaft. For the reversible engagement of the ratchet in a clutch member fixedly connected with the motor shaft, the ratchet has a pawl on the carrier that, with the aid of a guide element resting against a pawl pin, pivots during a starting process. On that side facing away from the carrier the pawl is spanned by an abutment element, at least in the region of its pivot axis.

28 Claims, 4 Drawing Sheets

STARTER MECHANISM FOR AN INTERNAL COMBUSTION ENGINE

BACKGROUND OF THE INVENTION

The present invention relates to a starter mechanism for an internal combustion engine, especially a rope or cord pull starter mechanism for a motor-driven, manually guided implement.

With one known starter mechanism for an internal combustion engine, a rope pull actuated clutch drum is rotatably disposed on a journal pin and acts upon a carrier of a ratchet. The ratchet serves for the transfer of a drive torque from the coupling drum to a motor shaft of the internal combustion engine. For this purpose, the ratchet is provided with a pivotable pawl on the carrier that is pivoted during the starting process with the aid of a sliding block type of guide that comprises a pawl pin on the pawl and a guide element that is embodied as a guide clamp; the pawl is reversibly engageable with a toothing of a coupling or clutch member. The clutch member is fixedly connected with the motor shaft, as a result of which the motor shaft is rotated.

The pawl is mounted with play, preferably taper bore mounted, on the carrier, so that during operation of the internal combustion engine axial play and tilting movements of the pawl cannot be precluded, as a result of which wear can occur on the pawl pin and on the guide clamp.

It is therefore an object of the present invention to improve a starter mechanism for internal combustion engines in such a way that the starter mechanism has a longer service life.

BRIEF DESCRIPTION OF THE DRAWINGS

This object, and other objects and advantages of the present invention, will appear more clearly with the following specification in conjunction with the accompanying schematic drawings, in which.

SUMMARY OF THE INVENTION

Figure 1:
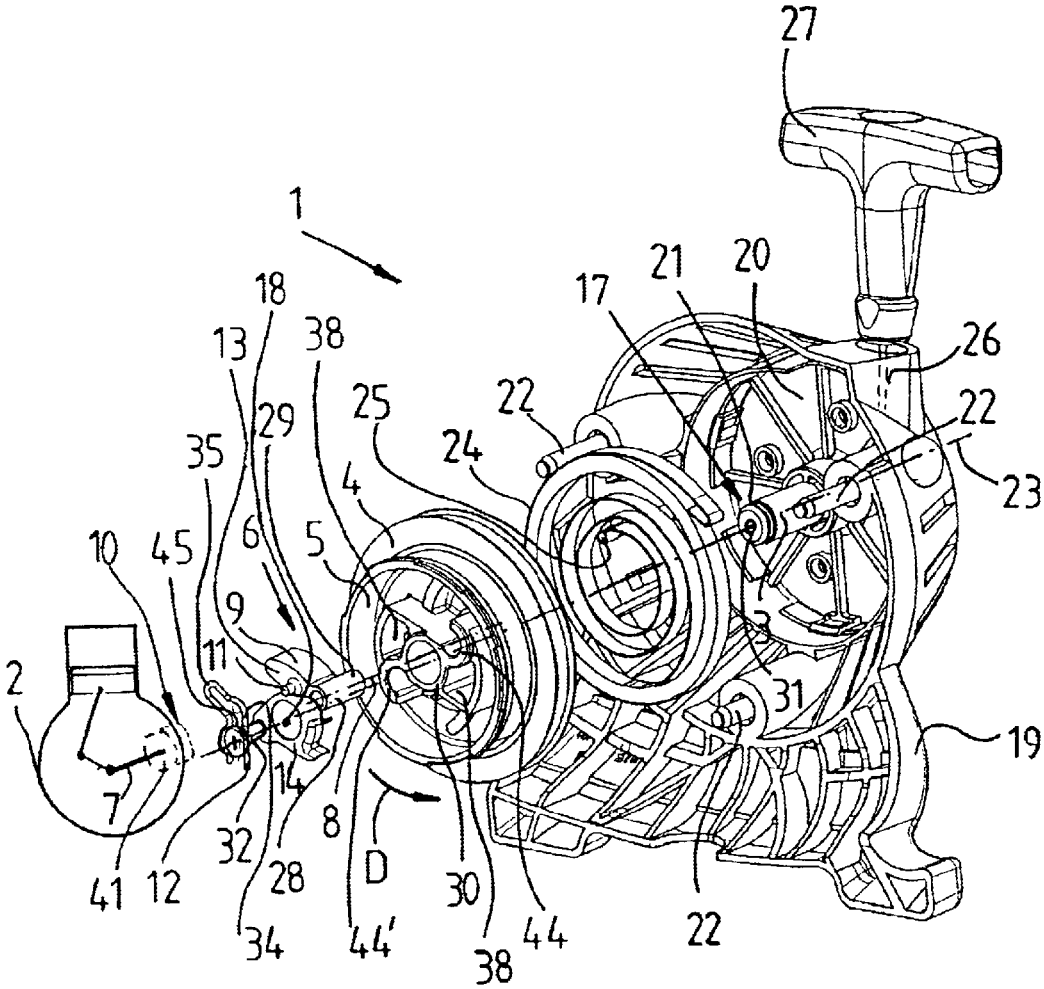
FIG. 1 is an exploded view of one exemplary embodiment of an inventive starter mechanism.

The starter mechanism of the present invention comprises: a clutch drum that is rotatably disposed about a journal pin; a carrier for a ratchet for transferring drive moment or torque on the clutch to the motor shaft of the engine, wherein the clutch drum is connected with the carrier; a pawl, as part of the ratchet, wherein the pawl is disposed on the carrier such that the pawl is pivotable about a pivot axis, wherein the pawl is reversibly engageable in a clutch member, and wherein the pawl is provided with a pawl pin; a guide element that rests against the pawl pin for a pivotable control of the pawl; and an abutment element that extends about a portion of the pawl from the side thereof that is remote from the carrier.

On that side on which it is not directly held and mounted on the carrier, the pawl is spanned on that side that faces away from the carrier by an abutment element, at least in the region of its pivot axis. Due to the fact that the abutment element preferably rests against the pawl, it forms an axial abutment relative to the pivot axis of the pawl. This improves the mounting of the pawl on the carrier; in particular, a tilting or canting of the pawl, for axial movement of the pawl, is thereby avoided during operation of the internal combustion engine. Wear of the pawl pin and the guide clamp or guide element is reduced. Disruptions in operation of the starter mechanism due to breaking or failure of the pawl pin or of the guide clamp are to a large extent precluded, whereby after failure of the pawl pin the pawl cannot escape from its guide means. Secondary damage to the starter mechanism is avoided.

The basic configuration of the abutment element is preferably such that it at least partially covers the pawl at its pivot axis, and thus the pawl is axially guided only in the region of its pivot axis and is secured against tilting. The abutment element is expediently positively or frictionally detachably fixed in position on the carrier, so that during operation of the internal combustion engine, with the exception of the pivoting of the pawl, no further relative movements of the abutment element relative to the pawl occur. Wear of the pawl due to rubbing against the abutment element is thereby minimized. The pawl is permanently guided and held on the carrier.

The abutment element is essentially flat and disk-shaped, and is preferably provided with a connecting tongue that is monolithically formed with the abutment element and preferably projects at an angle from the abutment element. The connecting tongue can be provided with a securement opening through which an appropriate securement element can be guided. The connecting tongue can nevertheless be formed in such a way that it can be positively, preferably in a positively clamping manner, mounted in an appropriate receiving means on the carrier. In this way, the abutment element can be easily pre-mounted on the carrier.

It is expedient to embody the connecting tongue with surfaces that are angled off toward one another, preferably providing a U-shaped configuration in cross-section, so that the connecting tongue is appropriately resistant to bending. Pursuant to one particularly preferred embodiment, the connecting tongue is bent out of the peripheral edge of the abutment element. The configuration of the abutment element itself is elliptical or rhombic. In the mounted state of the starter mechanism, the abutment element is preferably—when viewed in the axial direction of the pivot axis of the pawl—disposed between the pawl and the guide element or guide clamp.

It can be expedient to dispose two or more pawls on the carrier of the starter mechanism, whereby the configuration of the abutment element is such that it at least partially spans or extends about all of the pawls. The abutment element is provided with an opening, preferably a central circular opening, with which it surrounds an axial end of the journal pin with play, such axial end preferably having the shape of a collar stud. The abutment element is advantageously formed by being stamped and shaped from a metal plate, preferably from a steel plate.

Further specific features of the present invention will be described in detail subsequently.

DESCRIPTION OF PREFERRED EMBODIMENTS

Figure 2:
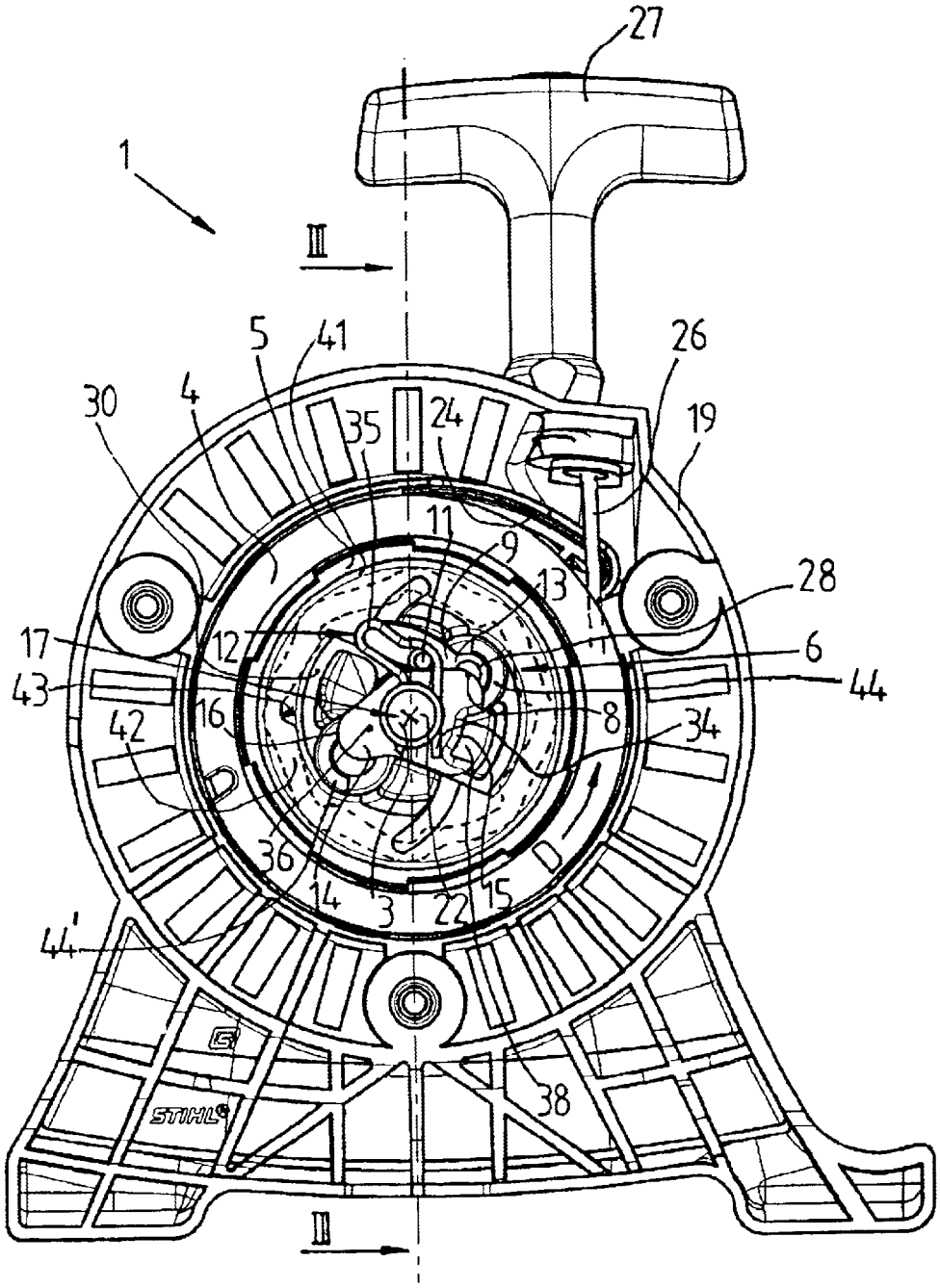
FIG. 2 is a plan view of the starter mechanism of FIG. 1.

Referring now to the drawings in detail, FIG. 1 shows a starter mechanism 1 for the manual starting of an internal combustion engine 2, for example for a motor-driven, manually guided implement, such as a blower, a power chain saw, or a brush cutter or trimmer. The starter mechanism 1, as is also shown in the cross-sectional view of FIG. 3 taken along the line III—III in FIG. 2, is accommodated in a housing 19. In the illustrated embodiment, the housing 19 is illustrated as a cover of an engine housing, with the cover surrounding the starter mechanism 1 in a cup-shaped manner with radial spacing. In the illustrated embodiment, the cover is monolithically formed in a light-weight construction, and has a correspondingly thin wall.

Figure 3:
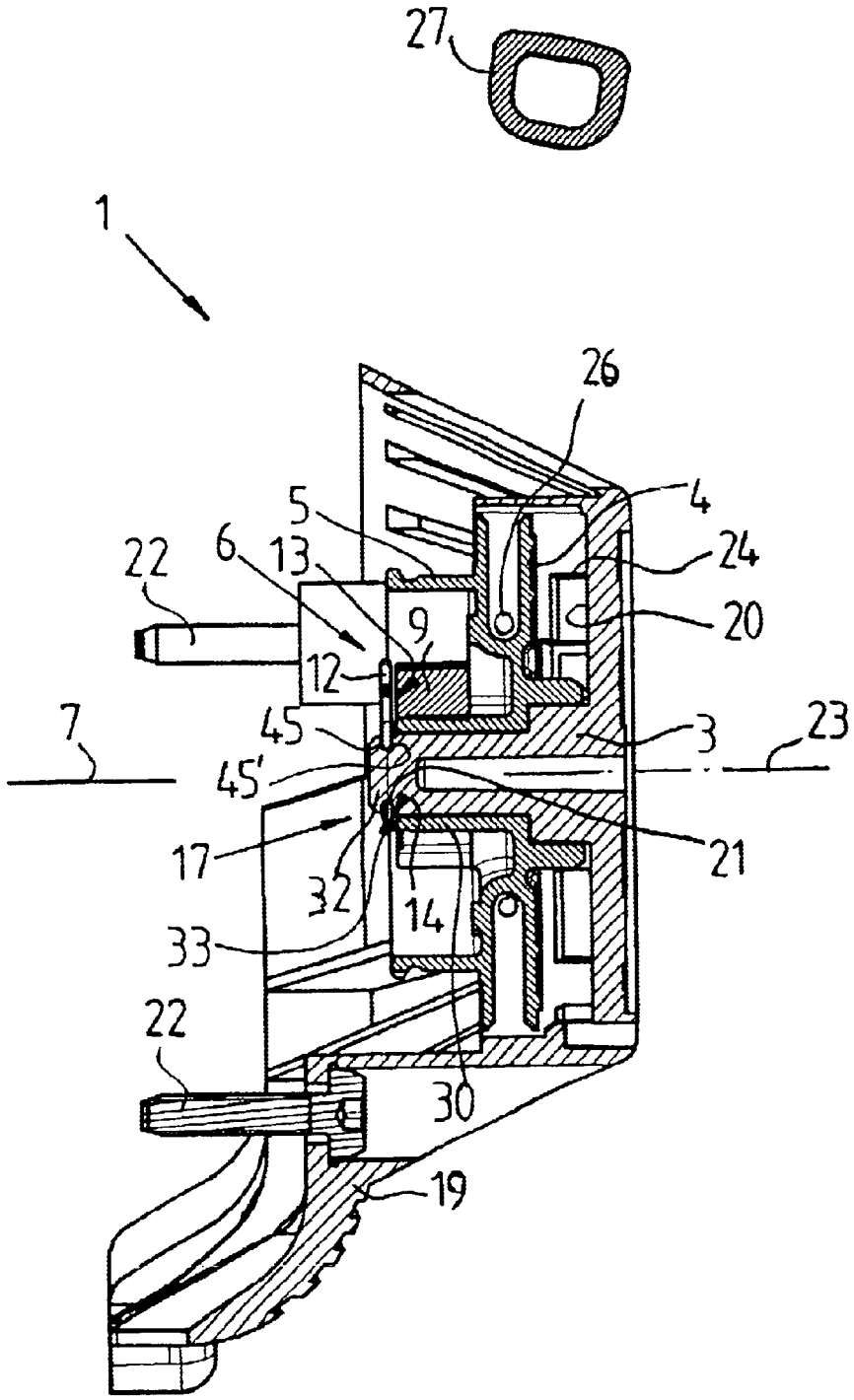
FIG. 3 is a cross-sectional view through the starter mechanism taken along the line III—III in FIG. 2.

Projecting from a planar, circular inner wall 20 of the cover is a pivot or journal pin 3, the interior of which is hollow (see FIG. 3). The journal pin 3 is formed of the same material as the cover, for example polymeric material or lightweight metal. It has a cylindrical shape, whereby when viewed in a longitudinal cross-section, it tapers in a stepped manner. The free axial end 17 of the pin 3 is provided with a reduced diameter section 21, so that the axial end 17 is embodied in the manner of a collar stud. The cover of the housing 19 is fixed in position on the motor housing with the aid of three threaded bolts 22, which are disposed approximately equidistantly from one another and relative to the longitudinal axis 23 of the journal pin 3. The threaded bolts 22 extend approximately parallel to the longitudinal axis 23 of the pin 3, and in the direction of extension of the pin 3 project out of the cover. In the cover, the journal pin 3 is surrounded by a helical spring 24, one end of which is connected to the rim of the housing. The helical spring 24 serves as a retraction spring for a coupling or clutch drum 4 that is slide-mounted on the journal pin 3. The clutch drum 4 is provided with a non-illustrated pin for the connection of an inner-housing end 25 of the spring 24. Wound onto the clutch drum 4 is a cable or cord 26 (see FIG. 2), the free end of which projects out of the housing, and on the free end of which is fastened a handle 27 in the form of a T-shaped grip. By pulling the cord 25 via the handle 27, the clutch drum 4 is rotated about the journal pin 3 in the direction of rotation D. The clutch drum 4 is monolithically formed with a carrier 5 of a ratchet 6; the cup-shaped carrier 5 surrounds the journal pin 3. The ratchet 6 is provided with a pawl 9 that is mounted in the carrier 5 so as to be pivotable about a pivot axis 8.

As FIG. 1 shows, the pawl 9 has a cylindrical widened portion 28 about its pivot axis 8. Via an axial end 29 of the widened portion 28, the pawl 9 is taper bore mounted in a bearing block or support element 30 of the carrier 5. Over its entire axial length, the widened portion 28 is additionally radially surrounded with a slight spacing, and guided, by half shells 44,44' that have the shape of a segment of a cylinder and extend in the axial direction of the support element 30, which is monolithically formed with the carrier 5. The clutch drum 4 is mounted on the journal pin 3 over its entire axial length. The pawl 9 carries a pawl pin 11, which projects outwardly in a direction opposite to the direction of extension of the widened portion 28. Threaded into an axial thread 31 on the axial end 17 of the journal pin 3 is a threaded bolt 32, in the head of which is provided a peripheral recess 45 (see also FIG. 3). A further peripheral recess 45' is provided at the axial end 17 of the journal pin 3. In the mounted state of the threaded bolt 32, the recesses 45,45' form an annular groove 33. Disposed in the annular groove 33 as a guide clamp is a guide element 12 that is made of spring steel wire and that in the state of rest of the clutch drum 4 extends around the pawl pin 11 via its free leg 34. The guide element 12 has a hairpin shaped bend 35 in which the pawl pin 11 is disposed. Between the guide element 12 and the support element 30 of the carrier 5, there is disposed an abutment element 14 that preferably slidingly comes to rest on that side 13 of the pawl 9 that faces away from the carrier. Relative to the pivot axis 8, the abutment element 14 forms an axial abutment. In this connection, in the vicinity of its pivot axis 8, the pawl 9 is covered in a crescent-shaped manner.

Figure 4A:
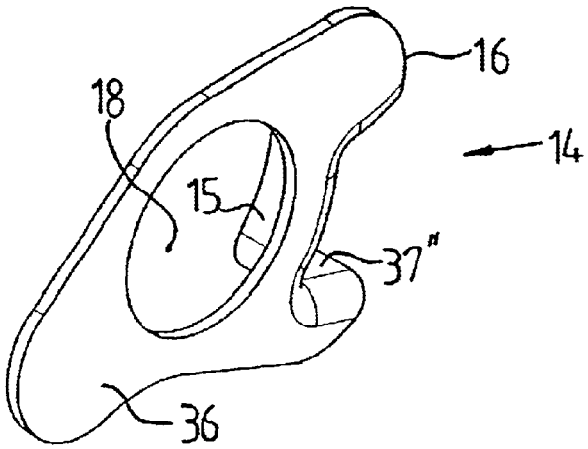
FIG. 4*a* is a view of an abutment element of the starter mechanism.
Figure 4B:
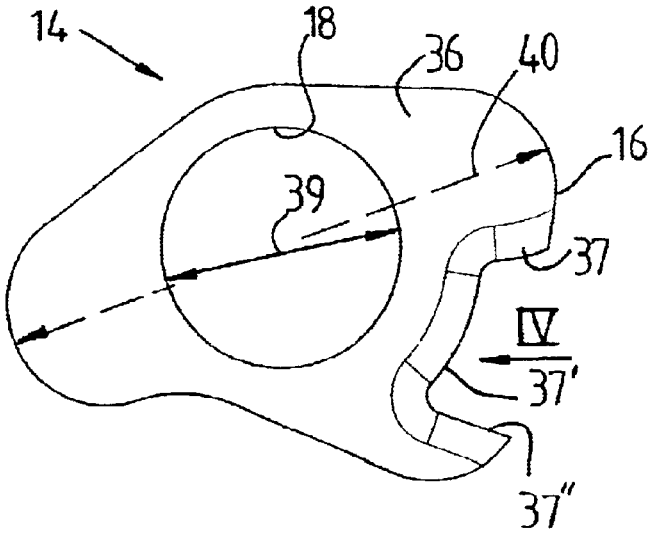
FIG. 4*b* is a plan view of the abutment element of FIG. 4*a*.
Figure 4C:
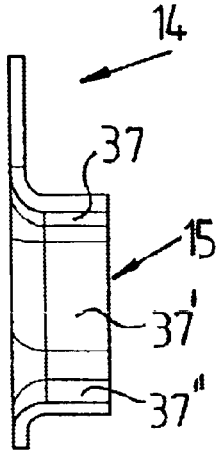
FIG. 4*c* is a view of the abutment element taken in the direction of the arrow IV in FIG. 4*b*.

The abutment element 14 can be seen in detail in a perspective view in FIGS. 1 and 4*a*, as well as in plan in FIGS. 2 and 4*b*. The abutment element is cut or stamped and formed from sheet metal, preferably from a steel plate, by bending out a connecting tongue 15 from the peripheral edge 16 of the abutment element. As can be seen from FIG. 4*c*, the connecting tongue 15 is bent approximately at right angles toward the support element 30 of the carrier 5 relative to the elliptical, disk-shaped main body 36 of the abutment element 14. When viewed in cross-section, the connecting tongue 15 is provided with surfaces 37, 37', 37" that are angled off toward one another and that in the illustrated embodiment provide a U-shaped cross-sectional course of the connecting tongue. The connecting tongue 15 engages in a receiving recess 38 in the support element 30 in a manner preferably free of play or in a slightly clamping manner. This effects a fixed, positively releasable connection of the abutment element 14 with the carrier 5.

The abutment element 14 has an approximately central opening 18, the diameter 39 of which is approximately half as great as the greatest length 40 of the main body 36 of the abutment element. By means of the opening 18, the abutment element 14 extends about the preferably collar stud like axial end 17 of the journal pin 3 with play. In the illustrated embodiment, the main body 36 of the abutment element 14 has an approximately symmetrical shape, so that it is thereby possible to cover two pawls 9 in the region of the pivot axis 8. It can be expedient to provide the starter mechanism 1 with more than two pawls. In accordance therewith, it is expedient to embody the main body 36 of the abutment element 14 in such a way that all of the pawls are covered on that side 13 thereof that faces away from the carrier 5. It can also be expedient to dispose the abutment element 14 on the support element 30 of the carrier 5 in such a way that a play remains between the main body 36 and the respective side 13 of the pawl 9.

Upon actuation of the starter mechanism 1, it is provided that the pawl 9 reversibly engages in a coupling or clutch member 10 (see FIG. 1). The clutch member 10 is fixedly connected with the motor shaft 7 of the internal combustion engine 2. In the embodiment of FIGS. 1 and 2, the clutch member 10 is a clutch cup 41 that is provided with a toothing 42 on its inner wall. In the assembled state of the starter mechanism 1, the toothing 42 of the clutch cup 41 engages in the cup-shaped carrier 5.

When the clutch drum 4 is rotated by pulling on the cord 26 via the handle 27, it takes along the carrier 5 and the support element 30. In so doing, the support element 30 of the ratchet 6 rotates about the journal pin 3, while the guide element initially maintains its position, since it is frictionally or positively connected with the threaded bolt 32 and thereby with the journal pin 3. With the aid of the abutment element 14, the pawl 9 is secured against axial displacement, vibration and counter tilting about its pivot axis 8. The pawl pin 11 of the pawl 9 migrates outwardly into the bend 35 of the guide element 12 in the direction toward the end of the bend, as a result of which the pawl 9 pivots radially outwardly. In this radially outwardly pivoted position, the pawl 9 takes along the guide element 12, which then rotates against the frictional resistance in the annular groove 33 of the threaded bolt 32 about the longitudinal axis 23 of the journal pin 3. During further rotation of the clutch drum 4, and hence of the ratchet 6, in the direction of the arrow D (see FIG. 2) the pawl 9 remains in its pivoted-out position and in so doing engages in a tooth base 43 of the toothing 42. This rotates the clutch cup 41 and hence the motor shaft 7 that is to be driven. If the internal combustion engine 2 is started and achieves the prescribed speed, the toothing 42 of the clutch cup 41 overtakes the ratchet 6, whereby the pawl 9 is again pivoted back into the position shown in FIG. 2.

The specification incorporates by reference the disclosure of German priority document 201 13 012.2 filed Aug. 4, 2001.

The present invention is, of course, in no way restricted to the specific disclosure of the specification and drawings, but also encompasses any modifications within the scope of the appended claims.

We claim:

1. A starter mechanism for an internal combustion engine comprising:

a clutch drum that is rotatably disposed about a journal pin;

a carrier for a ratchet for transferring a drive torque from said clutch drum to a shaft of said internal combustion engine, wherein said clutch drum is connected with said carrier;

a pawl, as part of said ratchet, wherein said pawl is disposed on said carrier such that said pawl is pivotable about a pivot axis, wherein said pawl is reversibly engageable in a clutch member, and wherein said pawl is provided with a pawl pin;

a guide element that rests against said pawl pin for a pivotable control of said pawl;

an abutment element that extends about a portion of said pawl on a side thereof that is remote from said carrier, wherein said abutment element has a disk-shaped configuration, and wherein said abutment element is provided with a connecting tongue for engagement in said carrier.

2. A starter mechanism according to claim 1, wherein said abutment element forms an axial abutment relative to said pivot axis of said pawl.

3. A starter mechanism according to claim 1, wherein said abutment element partially spans said pawl at its pivot axis.

4. A starter mechanism according to claim 1, wherein said abutment element is fixedly connected with said carrier.

5. A starter mechanism according to claim 4, wherein said abutment element is releasably fixed in position on said carrier.

6. A starter mechanism according to claim 5, wherein said abutment element is positively releasably fixed in position on said carrier.

7. A starter mechanism according to claim 1, wherein said connecting tongue is monolithically formed with said abutment element, and wherein said connecting tongue positively engages in said carrier.

8. A starter mechanism according to claim 1, wherein said connecting tongue has an angled-off cross-sectional configuration.

9. A starter mechanism according to claim 1, wherein said connecting tongue has an approximately U-shaped cross-sectional configuration.

10. A starter mechanism according to claim 1, wherein said connecting tongue is disposed on a peripheral edge of said abutment element.

11. A starter mechanism according to claim 1, wherein said abutment element has an elliptical configuration.

12. A starter mechanism according to claim 1, wherein said abutment element, in an axial direction of said pivot axis of said pawl, is disposed between said pawl and said guide element.

13. A starter mechanism according to claim 1, wherein at least two pawls are provided, wherein said pawls are spanned by said abutment element.

14. A starter mechanism according to claim 1, wherein said abutment element is provided with an approximately centrally disposed opening with which it surrounds, with play, an axial end of said journal pin.

15. A starter mechanism according to claim 14, wherein said axial end of said journal pin has the shape of a collar stud.

16. A starter mechanism according to claim 1, wherein said abutment element is disposed with slight play relative to said pawl.

17. A starter mechanism according to claim 1, wherein said abutment element is formed from sheet metal.

18. A starter mechanism according to claim 17, wherein said abutment element is formed from a steel plate.

19. A starter mechanism for an internal combustion engine, comprising:

a clutch drum that is rotatably disposed about a journal pin;

a carrier for a ratchet for transferring a drive torque from said clutch drum to a shaft of said internal combustion engine, wherein said clutch drum is connected with said carrier;

a pawl, as part of said ratchet, wherein said pawl is disposed on said carrier such that said pawl is pivotable about a pivot axis, wherein said pawl is reversibly engageable in a clutch member, and wherein said pawl is provided with a pawl pin;

a guide element that rests against said pawl pin for a pivotable control of said pawl;

an abutment element that extends about a portion of said pawl on a side thereof that is remote from said carrier, wherein said abutment element, in an axial direction of said pivot axis of said pawl, is disposed between said pawl and said guide element.

20. A starter mechanism according to claim 19, wherein said abutment element forms an axial abutment relative to said pivot axis of said pawl.

21. A starter mechanism according to claim 19, wherein said abutment element partially spans said pawl at its pivot axis.

22. A starter mechanism according to claim 19, wherein said abutment element is fixedly connected with said carrier.

23. A starter mechanism according to claim 22, wherein said abutment element is releasably fixed in position on said carrier.

24. A starter mechanism according to claim 23, wherein said abutment element is positively releasably fixed in position on said carrier.

25. A starter mechanism according to claim 19, wherein said abutment element is provided with an approximately centrally disposed opening with which it surrounds, with play, an axial end of said journal pin.

26. A starter mechanism according to claim 19, wherein said abutment element is disposed with slight play relative to said pawl.

27. A starter mechanism according to claim 19, wherein said abutment element is formed from sheet metal.

28. A starter mechanism according to claim 27, wherein said abutment element is formed from a steel plate.

* * * * *